US010400300B2

(12) United States Patent
Hasegawa et al.

(10) Patent No.: US 10,400,300 B2
(45) Date of Patent: Sep. 3, 2019

(54) HIGH-STRENGTH HOT-DIP GALVANIZED STEEL SHEET AND METHOD FOR MANUFACTURING THE SAME

(71) Applicant: JFE STEEL CORPORATION, Tokyo (JP)

(72) Inventors: Hiroshi Hasegawa, Fukuyama (JP); Koichiro Fujita, Nagoya (JP)

(73) Assignee: JFE STEEL CORPORATION, Tokyo (JP)

( * ) Notice: Subject to any disclaimer, the term of this patent is extended or adjusted under 35 U.S.C. 154(b) by 382 days.

(21) Appl. No.: 15/506,968

(22) PCT Filed: Aug. 14, 2015

(86) PCT No.: PCT/JP2015/004050

§ 371 (c)(1),
(2) Date: Feb. 27, 2017

(87) PCT Pub. No.: WO2016/031166

PCT Pub. Date: Mar. 3, 2016

(65) Prior Publication Data

US 2017/0283900 A1 Oct. 5, 2017

(30) Foreign Application Priority Data

Aug. 28, 2014 (JP) ..... 2014-174411

(51) Int. Cl.

| | |
|---|---|
| ***C21D 9/46*** | (2006.01) |
| ***C22C 38/38*** | (2006.01) |
| ***C23C 2/28*** | (2006.01) |
| ***C23C 2/40*** | (2006.01) |
| ***C22C 18/04*** | (2006.01) |
| ***C22C 38/00*** | (2006.01) |
| ***C22C 38/14*** | (2006.01) |
| ***C21D 8/04*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |

(52) U.S. Cl.

CPC ..... *C21D 9/46* (2013.01); *C21D 8/0436* (2013.01); *C22C 18/04* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/38* (2013.01); *C23C 2/28* (2013.01); *C23C 2/40* (2013.01); *C21D 2211/001* (2013.01); *C21D 2211/008* (2013.01)

(58) Field of Classification Search

CPC ..... C21D 2211/001; C21D 2211/008; C21D 9/46; C21D 38/00–04

See application file for complete search history.

(56) References Cited

U.S. PATENT DOCUMENTS

| | | | | |
|---|---|---|---|---|
| 2009/0214892 | A1* | 8/2009 | Kawamura ..... | C21D 8/0473 428/684 |
| 2010/0314009 | A1 | 12/2010 | Kaneko et al. | |
| 2011/0240176 | A1 | 10/2011 | Kaneko et al. | |
| 2012/0040203 | A1 | 2/2012 | Takagi et al. | |
| 2013/0273391 | A1 | 10/2013 | Hamada et al. | |

FOREIGN PATENT DOCUMENTS

| | | | |
|---|---|---|---|
| CA | 2742671 | A1 | 6/2010 |
| CN | 102227511 | A | 10/2011 |
| CN | 103717774 | A | 4/2014 |
| EP | 2371979 | | 10/2011 |
| EP | 2407568 | A1 | 1/2012 |
| EP | 2460901 | A1 | 6/2012 |
| EP | 2738276 | A1 | 6/2014 |
| EP | 2757171 | A1 | 7/2014 |

(Continued)

OTHER PUBLICATIONS

International Search Report and Written Opinion for International Application No. PCT/JP2015/004050, dated Nov. 2, 2015, 5 pages.
Chinese Office Action for Chinese Application No. 2015800467863, dated Dec. 19, 2017, including Concise Statement of Search Report, 7 pages.
Extended European Search Report for European Application No. 15835324.3, dated Oct. 26, 2017, 14 pages.

*Primary Examiner* — Lois L Zheng

(74) *Attorney, Agent, or Firm* — Ratnerprestia

(57) ABSTRACT

A high-strength hot-dip galvanized steel sheet and a method for manufacturing the steel sheet are provided. The high-strength hot-dip galvanized steel sheet has a specific composition including C, Si, Mn, etc. In this chemical composition, the content of Ti [Ti] and the content of N [N] satisfy [Ti]>4[N]. The high-strength hot-dip galvanized steel sheet has a microstructure including martensite at an area fraction of 60% or more and 90% or less, polygonal ferrite at an area fraction of more than 5% and 40% or less, and retained austenite at an area fraction of less than 3% (including 0%). The average hardness of the martensite is 450 or more and 600 or less in terms of Vickers hardness, and the average crystal grain diameter of the martensite is 10 μm or less. The standard deviation of the crystal grain diameters of the martensite is 4.0 μm or less.

20 Claims, No Drawings

(56) References Cited

FOREIGN PATENT DOCUMENTS

| | | | |
|---|---|---|---|
| EP | 2765212 | A1 | 8/2014 |
| EP | 2881481 | A1 | 6/2015 |
| JP | 2007070659 | A | 3/2007 |
| JP | 2009179852 | A | 8/2009 |
| JP | 2010255094 | A | 11/2010 |
| JP | 2010275628 | A | 12/2010 |
| JP | 2011032549 | A | 2/2011 |
| JP | 2012237042 | A | 12/2012 |
| JP | 2014005514 | A | 1/2014 |
| WO | 2014020640 | A1 | 2/2014 |

* cited by examiner

HIGH-STRENGTH HOT-DIP GALVANIZED STEEL SHEET AND METHOD FOR MANUFACTURING THE SAME

CROSS REFERENCE TO RELATED APPLICATIONS

This is the U.S. National Phase application of PCT/International Application No. PCT/JP2015/004050, filed Aug. 14, 2015, and claims priority to Japanese Patent Application No. 2014-174411, filed Aug. 28, 2014, the disclosures of each of these applications being incorporated herein by reference in their entireties for all purposes.

FIELD OF THE INVENTION

The present invention relates to a high-strength hot-dip galvanized steel sheet and to a method for manufacturing the same. Particularly, aspects of the present invention relate to a high-strength hot-dip galvanized steel sheet suitable for automobile steel sheet applications and excellent in ductility and in-plane uniformity of material properties and to a method for manufacturing the same.

BACKGROUND OF THE INVENTION

From the viewpoint of global environmental conservation, a constant and important issue in the automotive industry is to improve the fuel consumption of automobiles by reducing the weight of their bodies while the strength of the bodies is maintained in order to reduce $CO_2$ emissions. To achieve a reduction in the weight of automobile bodies while their strength is maintained, it is effective to increase the strength of steel sheets used as the materials of automobile parts to thereby allow the thickness of the steel sheets to be reduced. Many automobile parts made of steel sheets are formed by press forming, burring, etc. Therefore, high-strength steel sheets used as the materials of automobile parts are required to have, in addition to desired strength, high workability. Particularly, ultra-high-strength steel sheets having a tensile strength (TS) of 1,300 MPa or more are required to have, in view of ductility, excellent elongation characteristics (uniform elongation and local elongation). Moreover, high-strength hot-dip galvanized steel sheets are expected as steel sheets with excellent corrosion resistance. In view of the above circumstances, various high-strength steel sheets with excellent workability have been developed.

To increase the strength of a steel sheet, a large amount of alloy elements is added to the steel. This, however, presents a problem in that its manufacturability is impaired and deterioration in quality occurs such as a defective shape and in-plane non-uniformity of material properties, so that sufficient material performance cannot be provided. It is therefore very important to solve the above problem in a comprehensive manner.

As a technique for a high-strength steel sheet having excellent formability, Patent Literature 1 discloses a technique for a high-strength cold-rolled steel sheet having high strength, i.e., a TS of 1,180 MPa or more, and improved workability such as elongation, stretch flangeability, and bendability. Patent Literature 2 discloses a technique for a high-strength hot-dip galvanized steel sheet in the form of a steel strip with small non-uniformity of strength, excellent in formability, and having high strength, i.e., a TS of 780 MPa or more.

PATENT LITERATURE

PTL 1: Japanese Unexamined Patent Application Publication No. 2012-237042

PTL 2: Japanese Unexamined Patent Application Publication No. 2011-032549

SUMMARY OF THE INVENTION

However, in the technique described in Patent Literature 1, the content of Si is 1.2 to 2.2%. Since a large amount of Si is added as a steel component, problems may occur, such as a defective sheet shape caused by an increase in rolling load. Moreover, non-uniformity of material properties is not studied, and the uniformity of material properties is not considered to be sufficient.

Also in the technique described in Patent Literature 2, the content of Si is 0.5 to 2.5%. Particularly, in high-strength hot-dip galvanized steel sheets in Inventive Examples disclosed in Examples in Patent Literature 2, the content of Si is 1.09% or more. Since a large amount of Si is contained, problems may occur, such as stability of coating quality and a defective sheet shape due to an increase in rolling load. However, no consideration is given to these problems. In addition, no consideration is given to non-uniformity of properties other than strength.

It is an object of aspects of the present invention to advantageously solve the above-described problems in the conventional technology and to provide a high-strength hot-dip galvanized steel sheet having a tensile strength (TS) of 1,300 MPa or more and excellent in ductility and in-plane uniformity of material properties and a method for manufacturing the high-strength hot-dip galvanized steel sheet.

In order to achieve the above object and to manufacture a high-strength steel sheet that is excellent in ductility and in-plane uniformity of material properties while a TS of 1,300 MPa or more is ensured, the present inventors have conducted extensive studies from the viewpoint of the chemical composition and microstructure of the steel sheet and its manufacturing method and have found the following.

A high-strength hot-dip galvanized steel sheet having a TS of 1,300 MPa or more and excellent in ductility and in-plane uniformity of material properties can be obtained by setting the amount of C to 0.13 to 0.25%, the area fraction of martensite to 60 to 90%, the area fraction of polygonal ferrite to more than 5% and 40% or less, the area fraction of retained austenite to less than 3% (including 0%), the average crystal grain diameter of the martensite to 10 μm or less, the average hardness of the martensite to 450 or more and 600 or less in terms of Vickers hardness, and the standard deviation of the crystal grain diameters of the martensite to 4.0 μm or less. In accordance with aspects of the present invention, the in-plane uniformity of material properties is evaluated as non-uniformity of hole expandability that is highly sensitive to variations. Aspects of the present invention are based on the above findings, and a summary of aspects of the invention is as follows.

[1] A high-strength hot-dip galvanized steel sheet having a chemical composition comprising, in mass %, C: 0.13 to 0.25%, Si: 0.01 to 1.00%, Mn: 1.5 to 4.0%, P: 0.100% or less, S: 0.02% or less, Al: 0.01 to 1.50%, N: 0.001 to 0.010%, Ti: 0.005 to 0.100%, and B: 0.0005 to 0.0050%, with the balance being Fe and inevitable impurities, the content of Ti and the content of N satisfying formula (1) below, and the high-strength hot-dip galvanized steel sheet having a microstructure including martensite at an area fraction of 60% or more and 90% or less, polygonal ferrite at an area fraction of more than 5% and 40% or less, and less than 3% (including 0%) of retained austenite, wherein the martensite has an average hardness of 450 or more and 600 or less in terms of Vickers hardness, wherein the martensite has an average crystal grain diameter of 10 μm or less, and wherein the standard deviation of crystal grain diameters of the martensite is 4.0 μm or less:

$$[Ti]>4[N] \quad (1),$$

where [Ti] represents the content of Ti (mass %), and [N] represents the content of N (mass %).

[2] The high-strength hot-dip galvanized steel sheet according to [1], further comprising, in mass %, at least one element selected from Cr: 0.005 to 2.000%, Mo: 0.005 to 2.000%, V: 0.005 to 2.000%, Ni: 0.005 to 2.000%, Cu: 0.005 to 2.000%, and Nb: 0.005 to 2.000%.

[3] The high-strength hot-dip galvanized steel sheet according to [1] or [2], further comprising, in mass %, at least one element selected from Ca: 0.001 to 0.005% and REM: 0.001 to 0.005%.

[4] A method for manufacturing a high-strength hot-dip galvanized steel sheet, the method comprising: a hot rolling step of subjecting a steel slab having the chemical composition according to any one of [1] to [3] to hot rolling, performing cooling after completion of finishing rolling in the hot rolling such that a total residence time at 600 to 700° C. is 10 seconds or shorter, and then performing coiling such that an average coiling temperature is 400° C. or higher and lower than 600° C. and that the difference between an average value of coiling temperature in a 100 mm-wide region at a widthwise central position of the steel sheet and an average value of the coiling temperature in a 100 mm-wide region at a lateral edge position of the steel sheet is 70° C. or lower; a cold rolling step of cold-rolling the hot-rolled sheet obtained in the hot rolling step at a rolling reduction of more than 20%; an annealing step of heating the cold-rolled sheet obtained in the cold rolling step to 700° C. or lower at an average heating rate of 5° C./s or more, then heating the resulting cold-rolled sheet to 720° C. or higher and 850° C. or lower at an average heating rate of 1° C./s or less, and holding the resulting cold-rolled sheet at 720° C. or higher and 850° C. or lower for 30 seconds or longer and 1,000 seconds or shorter; a cooling step of cooling the cold-rolled sheet subjected to the annealing step at an average cooling rate of 3° C./s or more; a hot-dip galvanizing step of subjecting the cold-rolled sheet subjected to the cooling step to hot-dip galvanizing treatment; and a post-plating cooling step of cooling the hot-dip galvanized sheet subjected to the hot-dip galvanizing step such that a residence time in a temperature range of (an Ms point −50° C.) to the Ms point is 2 seconds or longer.

[5] The method for manufacturing a high-strength hot-dip galvanized steel sheet according to [4], the method further comprising, after the hot-dip galvanizing step and before the post-plating cooling step, a galvannealing step of subjecting the hot-dip galvanized steel sheet to galvannealing treatment.

[6] The method for manufacturing a high-strength hot-dip galvanized steel sheet according to [4] or [5], the method further comprising, after the post-plating cooling step, a tempering step of performing tempering treatment at a temperature of 350° C. or lower.

According to aspects of the present invention, a high-strength hot-dip galvanized steel sheet suitable as an automobile parts material having a tensile strength (TS) of 1,300 MPa or more and excellent in ductility and in-plane uniformity of material properties can be obtained.

DETAILED DESCRIPTION OF EMBODIMENTS OF THE INVENTION

The details of embodiments of the present invention will next be described. "%" representing the content of a component element means "mass %" unless otherwise specified.

1) Chemical Composition

C: 0.13 to 0.25%

C is an element necessary to form martensite to thereby increase TS. If the amount of C is less than 0.13%, the strength of the martensite is low, and the TS cannot be 1,300 MPa or more. If the amount of C exceeds 0.25%, local ductility such as local elongation decreases. Therefore, the amount of C is 0.13% or more to 0.25% or less. Preferably, the amount of C is 0.14% or more and 0.23% or less.

Si: 0.01 to 1.00%

Si is an element effective in increasing the TS through solid solution strengthening of the steel. To obtain this effect, thus the amount of Si must be 0.01% or more. When the amount of Si is excessively large, galvanizability and weldability deteriorate. Particularly, in this case, an increase in rolling load occurs, so that manufacturability is impaired. In accordance with aspects of the present invention, the allowable amount of Si mainly from the viewpoint of rolling load is 1.00%, and the amount of Si is 1.00% or more. Therefore, the amount of Si is 0.01% or more and 1.00% or less. The amount of Si is preferably 0.01% or more and 0.60% or less, more preferably 0.01% or more and 0.40% or less, and still more preferably 0.01% or more and 0.20% or less.

Mn: 1.5 to 4.0%

Mn is an element that increases the TS through solid solution strengthening of the steel and suppresses ferrite transformation and bainite transformation to allow martensite to form to thereby increase the TS. To obtain these effects sufficiently, the amount of Mn must be 1.5% or more. If the amount of Mn exceeds 4.0%, the amount of inclusions increases significantly, and this causes deterioration in cleanliness and local ductility of the steel. Therefore, the amount of Mn is 1.5 or more and 4.0% or less. The amount of Mn is preferably 1.5% or more and 3.8% or less and more preferably 1.8 or more and 3.5% or less.

P: 0.100% or less

P segregates at grain boundaries, and this causes deterioration in bendability and weldability. Therefore, it is desirable to reduce the amount of P as much as possible, but the allowable amount of P is 0.100%. In terms of manufacturing cost etc., the amount of P is 0.100% or less. Preferably, the amount of P is 0.03% or less. The lower limit of the amount of P is not particularly specified. However, if the amount of P is less than 0.001%, production efficiency becomes low. Therefore, the amount of P is preferably 0.001% or more.

S: 0.02% or less

S is present in the form of inclusions such as MnS and causes deterioration in weldability. Therefore, it is preferable to reduce the amount of S as much as possible, but the allowable amount of S is 0.02%. In terms of manufacturing cost, the amount of S is 0.02% or less. Preferably, the amount of S is 0.005% or less. The lower limit of the amount of S is not particularly specified. However, if the amount of S is less than 0.0005%, production efficiency becomes low. Therefore, the amount of S is preferably 0.0005% or more.

Al: 0.01 to 1.50%

Al is a ferrite-stabilizing element and has advantages in that a combination of Al and an appropriate amount of Mn allows proper phase fractions of ferrite and martensite to be obtained stably and also allows a rolling load and in-plane non-uniformity of material properties to be reduced. To obtain these effects, the amount of Al must be 0.01% or more. If the amount of Al exceeds 1.50%, the risk of slab cracking during continuous casting increases, and weld defects become significant. Therefore, the amount of Al is 0.01% or more and 1.50% or less. The amount of Al is preferably 0.05% or more and 1.10% or less and more preferably 0.15% or more and 0.80% or less.

N: 0.001 to 0.010%

N is fixed by Ti. Therefore, to bring out the effect of B, the range of N must be [Ti]>4[N]. However, if the amount of N exceeds 0.010%, the amount of TiN becomes excessive, and the microstructure of aspects of the present invention cannot be obtained. If the amount of N is less than 0.001%, the production efficiency becomes low. Therefore, the amount of N is 0.001 to 0.010%.

Ti: 0.005 to 0.100%

Ti is an element effective in suppressing recrystallization of ferrite during annealing to refine the crystal grains. To obtain this effect, the amount of Ti must be 0.005% or more. However, even if the amount of Ti exceeds 0.100%, the effect saturates, and an increase in cost results. Therefore, the amount of Ti is 0.005% or more and 0.100% or less. The amount of Ti is preferably 0.010% or more and 0.080% or less and more preferably 0.010% or more and 0.060% or less.

B: 0.0005 to 0.0050%

B is an element effective in suppressing nucleation of ferrite and bainite from grain boundaries to thereby obtain martensite. To obtain this effect sufficiently, the amount of B must be 0.0005% or more. If the amount of B exceeds 0.0050%, the effect saturates, and an increase in cost results. Therefore, the amount of B is 0.0005% or more and 0.0050% or less. The amount of B is preferably 0.0005% or more and 0.0030% or less and more preferably 0.0005% or more and 0.0020% or less.

$$[Ti]>4[N] \quad (1)$$

Ti fixes N and is an element effective in suppressing the formation of BN to thereby bring out the effect of B. To obtain this effect, the Ti content [Ti] and the N content [N] must satisfy formula (1) above, i.e., [Ti]>4[N]. In this formula, [Ti] is the content of Ti (mass %), and [N] is the content of N (mass %).

The balance is Fe and inevitable impurities. However, the following elements may be contained as needed.

At least one element selected from Cr: 0.005 to 2.000%, Mo: 0.005 to 2.000%, V: 0.005 to 2.000%, Ni: 0.005 to 2.000%, Cu: 0.005 to 2.000%, and Nb: 0.005 to 2.000%

Cr, Mo, V, Ni, Cu, and Nb are elements effective for an increase in strength because they allow a low-temperature transformation phase such as martensite to form. To obtain this effect, at least one element selected from these elements may be contained. The above effect can be obtained when the amount of any of Cr, Mo, V, Ni, Cu, and Nb is 0.005% or more. Therefore, when Cr, Mo, V, Ni, Cu, and Nb are contained, the amount of Cr, the amount of Mo, the amount of V, the amount of Ni, the amount of Cu, and the amount of Nb are each 0.005% or more. If the contents of Cr, Mo, V, Ni, Cu, and Nb exceed 2.000%, their effects saturate, and an increase in cost results. Therefore, when Cr, Mo, V, Ni, Cu, and Nb are contained, the amount of Cr, the amount of Mo, the amount of V, the amount of Ni, the amount of Cu, and the amount of Nb are each 2.000% or less. Therefore, the amount of Cr, the amount of Mo, the amount of V, the amount of Ni, the amount of Cu, and the amount of Nb are each 0.005 to 2.000%.

At least one selected from Ca: 0.001 to 0.005% and REM: 0.001 to 0.005%

Ca and REM are elements effective in controlling the shape of sulfides to improve workability. To obtain this effect, at least one element selected from Ca and REM may be contained. The above effect can be obtained when the amount of any of Ca and REM is 0.001% or more. Therefore, when Ca and REM are contained, the amount of Ca and the amounts of REM are each 0.001% or more. If the content of Ca and the contents of REM exceed 0.005%, the cleanliness of the steel may be adversely affected, and its properties may deteriorate. Therefore, when Ca and REM are contained, the amount of Ca and the amounts of REM are each 0.005% or less. Thus, the amount of Ca and the amounts of REM are each 0.001 to 0.005%.

2) Microstructure

Area fraction of martensite: 60% or more and 90% or less

If the area fraction of martensite is less than 60%, it is difficult to ensure a TS of 1,300 MPa or more, and therefore it is difficult to achieve a TS of 1,300 MPa or more and excellent ductility (elongation characteristics) simultaneously. If the area fraction of the martensite exceeds 90%, uniform ductility such as uniform elongation decreases significantly. Therefore, the area fraction of the martensite is 60 to 90% and preferably 65 to 90%. In accordance with aspects of the present invention, the martensite is one or both of auto-tempered martensite and tempered martensite and is carbide-containing martensite. The larger the amount of the tempered martensite contained, the higher the local ductility.

Area fraction of polygonal ferrite: more than 5% and 40% or less

If the area fraction of polygonal ferrite is 5% or less, the uniform elongation is low, and the total elongation is also low, so that excellent ductility cannot be achieved. If the area fraction of the polygonal ferrite exceeds 40%, it is difficult to ensure a TS of 1,300 MPa or more, and therefore it is difficult to achieve a TS of 1,300 MPa or more and excellent ductility (elongation characteristics) simultaneously. Therefore, the area fraction of the polygonal ferrite is more than 5% and 40% or less. Preferably, the area fraction of the polygonal ferrite is more than 5% and 30% or less.

Area fraction of retained austenite: less than 3% (including 0%)

Retained austenite is undesirable for the strength and local elongation, and it is preferable that the amount of the retained austenite contained is as small as possible. However, in accordance with aspects of the present invention, the allowable area fraction of the retained austenite is less than 3%. The area fraction of the retained austenite is preferably less than 2%.

Average hardness of martensite: 450 or more and 600 or less in terms of Vickers hardness If the average hardness of the martensite is less than 450 in terms of Vickers hardness, it is difficult to obtain a TS of 1,300 MPa or more. If the average hardness of the martensite exceeds 600 in terms of Vickers hardness, the local elongation decreases significantly. Therefore, the average hardness of the martensite is 450 or more and 600 or less in terms of Vickers hardness.

Average crystal grain diameter of martensite: 10 μm or less

If the average crystal grain diameter of the martensite exceeds 10 μm, the local ductility decreases significantly. Therefore, the average crystal grain diameter of the martensite is 10 μm or less and preferably 8 μm or less. If the average crystal grain diameter of the martensite is excessively small, the uniform elongation may decrease. Therefore, the average crystal grain diameter of the martensite is preferably 1 μm or more.

Standard deviation of crystal grain diameters of martensite: 4.0 μm or less

In accordance with aspects of the present invention, variations in the crystal grain diameters of the martensite, which is a principal phase, are an important factor for in-plane uniformity of material properties. If the standard deviation of the crystal grain diameters of the martensite exceeds 4.0 μm, the in-plane non-uniformity of material properties becomes significantly large. Therefore, the standard deviation of the crystal grain diameters of the martensite is 4.0 μm or less, preferably 3.0 μm or less, and more preferably 2.0 μm or less.

In addition to the martensite, polygonal ferrite, and retained austenite described above, other phases such as bainite, perlite, and fresh martensite may be contained. However, these phases are undesirable for achieving desired strength and local elongation simultaneously in some cases. Therefore, the total area fraction of these phases is preferably less than 20%, and the total area fraction of the martensite, polygonal ferrite, and retained austenite described above is preferably more than 80%. More preferably, the total area fraction of the microstructures other than the martensite, polygonal ferrite, and retained austenite described above is less than 10%, i.e., the total area fraction of the martensite, polygonal ferrite, and retained austenite described above is more than 90%.

The area fractions of the martensite and the polygonal ferrite are the ratios of the areas of these respective phases to the area of observation. The area fractions of the martensite and the polygonal ferrite are determined as follows. A sample is cut from a widthwise central portion of the steel sheet, and a cross section of the sample in its thickness direction is polished and then etched with a 3% nital solution. Then images of fields of view are taken at three positions one-fourth of the sheet thickness under an SEM (scanning electron microscope) at a magnification of 1,500×. The area fraction of each phase is determined from the obtained image data using Image-Pro manufactured by Media Cybernetics. The area fraction of each phase is the average of the area fractions in the fields of view. In the image data, the polygonal ferrite can be distinguished because it appears as black regions, and the martensite can be distinguished because it appears as white regions containing carbides. Phases other than the polygonal ferrite and the martensite include a white phase containing no carbides and a microstructure in which carbides, martensite-austenite constituent, etc. are contained in a black or gray matrix, and therefore these phases can be distinguished from the polygonal ferrite and the martensite. The above martensite phase does not include martensite-austenite constituent. The average crystal grain diameter of the martensite is determined as follows. In the image data used to determine the area fractions, the total area of the martensite in the fields of view is divided by the number of martensite grains to determine the average area, and the square root of the average area is used as the average grain diameter of the martensite. The standard deviation of the crystal grain diameters of the martensite is determined as follows. The area of each of the martensite grains in the image data is determined, and the square root of the area is used as the diameter of the grain. The standard deviation obtained from all the obtained martensite grain diameters is used as the standard deviation of the crystal grain diameters of the martensite.

The area fraction of the retained austenite is determined as follows. The steel sheet is ground to a position one-fourth of the thickness of the sheet and then further polished by 0.1 mm by chemical polishing. Next, on the polished surface, the Mo Kα line in an X-ray diffractometer is used to measure integrated reflection intensities of (200), (220), and (311) planes of fcc iron (austenite) and (200), (211), and (220) planes of bcc iron (ferrite). The volume fraction of the retained austenite is determined from the intensity ratios of the integrated reflection intensities of the above planes of fcc iron (austenite) to the integrated reflection intensities of the above planes of bcc iron (ferrite) and is used as the area fraction of the retained austenite.

The high-strength hot-dip galvanized steel sheet of aspects of the present invention has a hot-dip galvanized layer on its surface, and no particular limitation is imposed on the coating weigh etc. of the hot-dip galvanized layer. The high-strength hot-dip galvanized steel sheet may include a hot-dip galvannealed layer. Preferably, the coating weight is 35 to 45 g/m$^2$.

3) Manufacturing Conditions

The high-strength hot-dip galvanized steel sheet of aspects of the present invention can be manufactured, for example, by performing: a hot rolling step of subjecting a steel slab having the chemical composition described above to hot rolling to thereby obtain a hot-rolled sheet, cooling the hot-rolled sheet after completion of finishing rolling in the hot rolling such that a total residence time at 600 to 700° C. is 10 seconds or shorter, and then coiling the resulting hot-rolled sheet such that an average coiling temperature is 400° C. or higher and lower than 600° C. and that the difference between an average value of coiling temperature in a 100 mm-wide region at a widthwise central position of the steel sheet and an average value of the coiling temperature in a 100 mm-wide region at a lateral edge position of the steel sheet is 70° C. or lower; a cold rolling step of cold-rolling the hot-rolled sheet at a rolling reduction of more than 20% to thereby obtain a cold-rolled sheet; an annealing step of heating the cold-rolled sheet to 700° C. or lower at an average heating rate of 5° C./s or more, then heating the resulting cold-rolled sheet to 720° C. or higher and 850° C. or lower at an average heating rate of 1° C./s or less, and holding the resulting cold-rolled sheet at 720° C. or higher and 850° C. or lower for 30 seconds or longer and 1,000 seconds or shorter; a cooling step of cooling the cold-rolled sheet subjected to the annealing step at an average cooling rate of 3° C./s or more; a hot-dip galvanizing step of subjecting the cold-rolled sheet subjected to the cooling step to hot-dip galvanizing treatment to obtain a hot-dip galvanized sheet; and a post-plating cooling step of cooling the hot-dip galvanized sheet such that a residence time in a temperature range of (an Ms point −50° C.) to the Ms point is 2 seconds or longer. After the hot-dip galvanizing step and before the post-plating cooling step, a galvannealing step of performing galvannealing treatment may be performed. After the post-plating cooling step, a tempering step of performing tempering treatment at a temperature of 350° C. or lower may be performed.

The manufacturing conditions of the above high-strength hot-dip galvanized steel sheet will be described in detail.

(Hot Rolling Step)

Total residence time at 600 to 700° C. after completion of finishing rolling in hot rolling: 10 seconds or shorter The steel slab having the chemical composition described above is hot-rolled, cooled, and coiled in the hot rolling step to thereby obtain a hot-rolled sheet. During the cooling performed after the hot rolling, if the residence time at 600 to 700° C. after completion of the finishing rolling in the hot rolling exceeds 10 seconds, B-containing compounds such as B carbide are formed, and the amount of solute B in the steel is reduced. In this case, ferrite is mixed in the hot-rolled sheet, causing non-uniformity of the microstructure after annealing. In addition, the effect of B during annealing is reduced, and therefore the microstructure according to aspects of the present invention is not obtained. Therefore, the total residence time at 600 to 700° C. after completion of the finishing rolling in the hot rolling is 10 seconds or shorter and preferably 8 seconds or shorter.

Average coiling temperature: 400° C. or higher and lower than 600° C.

If the average coiling temperature is 600° C. or higher, B-containing compounds such as B carbide are formed, and the amount of solute B in the steel is reduced. In this case, ferrite is mixed in the hot-rolled sheet, causing non-uniformity of the microstructure after annealing. In addition, the effect of B during annealing is reduced, and therefore the microstructure according to aspects of the present invention is not obtained. If the average coiling temperature is lower than 400° C., the shape of the steel sheet deteriorates. Therefore, the average coiling temperature is 400° C. or higher and lower than 600° C. The average coiling temperature is the average value of the coiling temperature in a widthwise central portion of the steel sheet over its entire length, i.e., the average temperature obtained by averaging the coiling temperature in the widthwise central portion of the steel sheet over its entire length.

Difference between the average value of the coiling temperature in the 100 mm-wide region at the widthwise central position of the steel sheet and the average value of the coiling temperature in the 100 mm-wide region at the lateral edge position of the steel sheet: 70° C. or less Lateral edge portions of a steel sheet after hot rolling are generally easily cooled, and their temperature is lower than the temperature of the widthwise central position. In accordance with aspects of the present invention, if the average value of the coiling temperature in the 100 mm-wide region at the lateral edge position of the steel sheet immediately before coiling is lower by more than 70° C. than the average value of the coiling temperature in the 100 mm-wide region at the widthwise central position of the steel sheet, the amount of martensite contained in the hot-rolled sheet microstructure near the lateral edges of the sheet increases significantly, and the variations in the grain diameters in the microstructure after annealing become large, so that the microstructure according to aspects of the present invention is not obtained. The 100 mm-wide region at the lateral edge position of the steel sheet is a region extending 100 mm from an outermost lateral edge of the steel sheet toward its widthwise central portion, and the 100 mm-wide region at the widthwise central position of the steel sheet is a region extending 100 mm in the width direction of the sheet with the center of this region at the widthwise center of the steel sheet. Therefore, the difference between the average value of the coiling temperature in the 100 mm-wide region at the widthwise central position of the steel sheet and the average value of the coiling temperature in the 100 mm-wide region at the lateral edge position of the steel sheet is 70° C. or less. Preferably, the difference between the average value of the coiling temperature in the 100 mm-wide region at the widthwise central position of the steel sheet and the average value of the coiling temperature in the 100 mm-wide region at the lateral edge position of the steel sheet is 50° C. or less. Any method may be used to make the temperature uniform, and for example, the temperature can be made uniform by controlling masking or the like on both edges of the coil during cooling. The average value of the coiling temperature is the average value of the coiling temperature over the entire length of the coil. The 100 mm-wide region at the widthwise central position is a region ±50 mm from the widthwise central position, and the average coiling temperature of the 100 mm-wide region at the lateral edge position is the lower one of the average coiling temperatures of regions extending 100 mm from both edges of the sheet. The coiling temperature can be measured using, for example, a radiation thermometer.

(Cold Rolling Step)

Rolling reduction during cold rolling: more than 20%

The hot-rolled sheet obtained in the hot rolling step is cold-rolled in the cold rolling step to obtain a cold-rolled sheet. If the rolling reduction during the cold rolling is 20% or less, a difference in strain is likely to occur between the surface layer of the hot-rolled sheet and its interior during annealing, and this causes non-uniformity of crystal grain diameters. In this case, the microstructure according to aspects of the present invention is not obtained, and the local ductility deteriorates. Therefore, the rolling reduction during the cold rolling is more than 20%. Preferably, the rolling reduction during the cold rolling is 30% or more. The upper limit of the rolling reduction is not particularly specified. However, from the viewpoint of shape stability etc., the rolling reduction during the cold rolling is preferably 90% or less.

(Annealing Step)

Heating to 700° C. or lower at an average heating rate of 5° C./s or more

The cold-rolled sheet obtained in the cold rolling step is subjected to the annealing step. If the average heating rate during heating to 700° C. or lower in the annealing step is less than 5° C./s, carbides become coarse and remain undissolved even after annealing, and this causes a reduction in hardness of martensite and excessive formation of ferrite and bainite. Therefore, the average heating rate is 5° C./s or more. The upper limit of the average heating rate is not particularly specified. However, from the viewpoint of production stability, the average heating rate is preferably 500° C./s or less. If the maximum temperature during heating at the above heating rate (the maximum heating temperature) exceeds 700° C., austenite is formed abruptly and non-uniformly, so that the microstructure according to aspects of the present invention is not obtained. Therefore, the cold-rolled sheet is heated to 700° C. or lower at an average heating rate of 5° C./s or more. The lower limit of the maximum heating temperature is not particularly specified. If the maximum heating temperature is lower than 550° C., the productivity is impaired, so that the maximum heating temperature is preferably 550° C. or higher. The above average heating rate is the average of the heating rate from heating start temperature to the maximum heating temperature.

Heating to 720° C. or higher and 850° C. or lower at an average heating rate of 1° C./s or less After the cold-rolled sheet is heated to the maximum heating temperature, the resulting cold-rolled sheet is heated to an annealing temperature of 720° C. or higher and 850° C. or lower at an average heating rate of 1° C./s or less. If the average heating rate during heating from the maximum heating temperature exceeds 1° C./s, austenite grains become irregular in size, and the microstructure according to aspects of the present invention is not obtained. Therefore, the average heating rate during heating to 720° C. or higher and 850° C. or lower after the heating to the maximum heating temperature is 1° C./s or less. The above average heating rate is the average of the heating rate during heating from the maximum heating temperature to the annealing temperature.

Holding at 720° C. or higher and 850° C. or lower for 30 seconds or longer and 1,000 seconds or shorter If the annealing temperature is lower than 720° C., the formation of austenite is insufficient, and ferrite is formed excessively, so that the microstructure according to aspects of the present invention is not obtained. If the annealing temperature exceeds 850° C., austenite grains become coarse, and ferrite disappears, so that the microstructure according to aspects of the present invention is not obtained. Therefore, the annealing temperature is 720° C. or higher and 850° C. or lower. Preferably, the annealing temperature is 750° C. or higher and 830° C. or lower. If the holding time at the annealing temperature, i.e., 720° C. or higher and 850° C. or lower, (annealing holding time) is shorter than 30 seconds, the formation of austenite is insufficient, so that the microstructure according to aspects of the present invention is not obtained. If the holding time exceeds 1,000 seconds, the austenite grains become coarse, so that the microstructure according to aspects of the present invention is not obtained. Therefore, the holding time at 720° C. or higher and 850° C. or lower is 30 seconds or longer and 1,000 seconds or shorter. Preferably, the holding time is 30 seconds or longer and 500 seconds or shorter.

(Cooling Step)

Cooling at an average cooling rate of 3° C./s or more

The cold-rolled sheet subjected to the annealing step is subjected to the cooling step of cooling at an average cooling rate of 3° C./s or more and then subjected to hot-dip galvanization. If the average cooling rate is less than 3° C./s, ferrite and bainite are formed excessively during cooling and holding, so that the microstructure according to aspects of the present invention is not obtained. Therefore, the average cooling rate is 3° C./s or more. Preferably, the average cooling rate is 5° C./s or more. From the viewpoint of, for example, suppressing the occurrence of a defective shape due to uneven cooling, it is preferable that the upper limit of the average cooling rate is 100° C./s or less. The above average cooling rate is the average of the cooling rate during cooling from the annealing temperature to cooling stop temperature (the temperature of the steel sheet when it enters a galvanizing bath).

(Hot-Dip Galvanizing Step)•(Galvannealing Step)

The cold-rolled sheet subjected to the cooling step is subjected to hot-dip galvanizing treatment in the hot-dip galvanizing step to form a hot-dip galvanized layer on the surface of the steel sheet to thereby obtain a hot-dip galvanized sheet. The hot-dip galvanizing treatment may be performed according to a routine procedure. Preferably, the hot-dip galvanizing treatment is performed by immersing the above-obtained steel sheet (cold-rolled sheet) in a galvanizing bath at 440° C. or higher and 500° C. or lower and then controlling the coating weight by, for example, gas wiping. When galvannealing treatment for galvannealing the hot-dip galvanized layer is performed in the galvannealing step after the hot-dip galvanizing treatment, it is preferable to perform the galvannealing by holding the hot-dip galvanized sheet in the temperature range of from 460° C. to 580° C. inclusive for 1 second or longer and 40 seconds or shorter. Preferably, the hot-dip galvanization is performed using a galvanizing bath with an Al content of 0.08 to 0.25% by mass.

(Post-Plating Cooling Step)

Cooling such that the residence time in the temperature range of (Ms point −50° C.) to Ms point is 2 seconds or longer The hot-dip galvanized sheet obtained in the hot-dip galvanizing step or the hot-dip galvannealed sheet obtained by subjecting the hot-dip galvanized sheet to the galvannealing step is cooled such that the residence time in the temperature range of (the Ms point −50° C.) to the Ms point is 2 seconds or longer. Specifically, immediately after the hot-dip galvanizing treatment or the galvannealing treatment, cooing is performed such that the residence time in the temperature range of (the Ms point −50° C.) to the Ms point is 2 seconds or longer. If the residence time in the temperature range of (the Ms point −50° C.) to the Ms point is shorter than 2 seconds, auto-tempering of the martensite in the steel sheet is insufficient, and the local ductility deteriorates. Therefore, the residence time in the temperature range of (the Ms point −50° C.) to the Ms point is 2 seconds or longer. Preferably, the residence time in the temperature range of (the Ms point −50° C.) to the Ms point is 5 seconds or longer. The Ms point is the temperature at which martensite transformation starts. The auto-tempering is a phenomenon in which the formed martensite is tempered during cooling. In accordance with aspects of the present invention, the Ms point is determined by measurement of expansion of a sample during cooling.

(Tempering Step)

After the post-plating cooling step described above, the tempering step may be performed. After the post-plating cooling step, reheating to a tempering temperature of 350° C. or lower may be performed to further improve the local ductility. If the tempering temperature exceeds 350° C., the coating quality deteriorates, and therefore the tempering temperature must be 350° C. or lower. The tempering treatment may be performed by any method using a continuous annealing furnace, a box annealing furnace, etc. When the steel sheet comes into contact with itself, e.g., when the steel sheet is coiled into a coil shape and then subjected to tempering treatment, it is preferable that the tempering time is 24 hours or shorter, from the viewpoint of suppressing adhesion etc. Preferably, the tempering time is 1 second or longer.

The steel sheet subjected to the hot-dip galvanizing treatment or the steel sheet further subjected to the galvannealing treatment may be subjected to temper rolling for the purpose of shape correction and surface roughness adjustment. Moreover, coating treatment such as resin coating or oil and fat coating may be performed.

No particular limitation is imposed on the manufacturing conditions other than the conditions described above. However, preferably, the manufacturing is performed under the following conditions.

In order to prevent macro-segregation, it is preferable to manufacture the steel slab by a continuous casting method. The steel slab may be manufactured by an ingot-making method or a thin slab casting method. When the steel slab is hot-rolled, the steel slab may be first cooled to room temperature, then reheated, and subjected to hot-rolling. The steel slab may be placed in a heating furnace without cooling to room temperature and then hot-rolled. Alternatively, an energy-saving process may be used, in which the steel slab is hot-rolled directly after short heat retaining treatment. When the steel slab is heated, it is preferable to heat the steel slab to 1,100° C. or higher in order to dissolve carbides and to prevent an increase in rolling load. In order to prevent an increase in scale loss, it is preferable that the heating temperature of the steel slab is 1,300° C. or lower.

When the steel slab is hot-rolled, a rough bar obtained by rough rolling in the hot rolling may be heated, from the viewpoint of preventing troubles during the rolling in the case that the heating temperature of the steel slab is low. Alternatively, a so-called continuous rolling process may be employed, in which rough bars are joined together and then subjected to finishing rolling in the hot rolling in a continuous manner. Preferably, the finishing rolling in the hot rolling is performed at a finishing temperature equal to or higher than Ar3 transformation temperature. Otherwise, anisotropy may increase, and workability after cold rolling and annealing may be reduced. In order to reduce the rolling load and to make the shape and material properties of the hot-rolled slab uniform, it is preferable that lubrication rolling that allows the coefficient of friction to be 0.10 to 0.25 is performed in all or part of passes of the finishing rolling.

Preferably, the coiled steel sheet is, for example, pickled to remove scales according to a routine procedure and then subjected to cold rolling under the conditions described above.

Example 1

Molten steel having a chemical composition shown in Table 1 was produced in a vacuum melting furnace, and a steel slab was obtained by a continuous casting method. In Table 1, [Ti]/4[N] of steel J is 1.0. More specifically, this shows that [Ti]/4[N] is more than 1.00 and less than 1.05. Each steel slab was heated to 1,200° C., then subjected to hot rolling including rough rolling and finishing rolling, cooled under the conditions shown in Table 2, and coiled to obtain a hot-rolled steel strip (hot-rolled sheet). Next, the obtained hot-rolled sheet was cold-rolled to 1.4 mm at a cold rolling reduction shown in Table 2 to thereby manufacture a cold-rolled steel strip (cold-rolled sheet), and the cold-rolled sheet was subjected to annealing. The annealing was performed in a continuous hot-dip galvanizing line under the conditions shown in Table 2 to thereby produce hot-dip galvanized steel sheets and hot-dip galvannealed steel sheets Nos. 1 to 29. Each hot-dip galvanized steel sheet was produced by immersion in a galvanizing bath at 460° C. to form a galvanized layer with a coating weight of 35 to 45 g/m$^2$, and each hot-dip galvannealed steel sheet was produced by galvannealing treatment at 460 to 580° C. performed after the formation of the galvanized layer. Each of the obtained coated steel sheets was subjected to skin pass rolling at 0.2% (temper rolling). Then microstructure observation was performed using a test method described later, and tensile properties, in-plane uniformity of material properties, and hardness were determined. The surface appearance of the coated steel sheet was visually checked to evaluate galvanizability on a scale of 1 to 5 (1: many bare spots, 2: bare spots in some parts, 3: no bare spots, but clear scale patterns were found, 4: no bare spots, but slight scale patterns were found, 5: no bare spots and no scale patterns). A rating of 3 or higher is considered good. The rating of 4 or higher is preferable and that of 5 is more preferable. A rolling load, which causes a defective shape, was evaluated using the product of a hot rolling linear load and a cold rolling linear load. A product of less than 4,000,000 kgf$^2$/mm$^2$ is considered good. The product is of 3,000,000 kgf$^2$/mm$^2$ or less is preferable.

<Microstructure Observation>

A sample was cut from a widthwise central portion of a steel sheet, and a cross section of the sample in its thickness direction was polished and then etched with a 3% nital solution. Then images of fields of view were taken at three positions one-fourth of the sheet thickness under an SEM (scanning electron microscope) at a magnification of 1,500×. The area fraction of each phase was determined from the obtained image data using Image-Pro manufactured by Media Cybernetics. The area fraction of each phase is the average of the area fractions in the fields of view. In the image data, polygonal ferrite can be distinguished because it appears as black regions, and martensite can be distinguished because it appears as white regions containing carbides. Phases other than the polygonal ferrite and the martensite include either a white phase containing no carbides or a microstructure in which carbides, martensite-austenite constituent, etc. are contained in a black or gray matrix, and therefore these phases can be distinguished from the polygonal ferrite and the martensite. The above martensite phase does not include martensite-austenite constituent. The average crystal grain diameter of the martensite was determined as follows. In the image data used to determine the area fractions, the total area of the martensite in the fields of view was divided by the number of martensite grains therein to determine the average area, and the square root of the average area was used as the average grain diameter of the martensite. The standard deviation of the crystal grain diameters of the martensite was determined as follows. The area of each of the martensite grains in the image data was determined, and the square root of the diameter was used as the diameter of the grain. The standard deviation obtained from all the obtained martensite grain diameters was used as the standard deviation of the crystal grain diameters of the martensite.

The area fraction of retained austenite was determined as follows. The steel sheet was ground to a position one-fourth of the thickness of the sheet and then further polished by 0.1 mm by chemical polishing. Next, on the polished surface, the Mo Kα line in an X-ray diffractometer was used to measure integrated reflection intensities of (200), (220), and (311) planes of fcc iron (austenite) and (200), (211), and (220) planes of bcc iron (ferrite). The volume fraction of the retained austenite was determined from the intensity ratios of the integrated reflection intensities of the above planes of fcc iron (austenite) to the integrated reflection intensities of the above planes of bcc iron (ferrite) and was used as the area fraction of the retained austenite.

<Tensile Test>

A JIS No. 5 tensile test piece (JIS 22201) was cut from a widthwise central portion of a steel sheet so as to be parallel to the rolling direction and subjected to a tensile test according to the specifications of JIS Z 2241 at a strain rate of $10^{-3}$/s to determine TS, uniform elongation, and local elongation. The uniform ductility was evaluated using the uniform elongation, and the local ductility was evaluated using the local elongation.

<In-Plane Uniformity of Material Properties>

Three 150 mm×150 mm test pieces were cut from each of both lateral edge portions, a widthwise ¼ portion, a widthwise ¾ portion, and a widthwise central portion of a steel sheet and subjected to a hole expanding test according to JFST 1001 (The Japan Iron and Steel Federation Standard). Then the standard deviation (σ(λ)) of the obtained 15 hole expanding ratios λ(%) was computed. A steel sheet with a standard deviation (σ(λ)) of 4% or more was considered to have poor in-plane uniformity of material properties.

<Hardness Test>

A test piece having a width of 10 mm and a length of 15 mm was taken so as to have a cross section parallel to the rolling direction, and measurement of the Vickers hardness of martensite was performed at a position 200 μm from the surface in a depth direction (the thickness direction of the sheet). The measurement was performed at five points with a load of 100 g, and the average of three Vickers hardness (Hv) values other than the maximum and minimum values was used as the hardness Hv.

The results are shown in Table 3. It was shown that, in accordance with aspects of the present invention, the TS was 1,300 MPa or more, so the strength was high. In addition, the uniform elongation was 5.5% or more, so the uniform ductility was excellent. The local elongation was 3% or more, so the local ductility was excellent. Therefore, the ductility was excellent. The standard deviation of the hole expandability λ(%) was less than 4%, so the in-plane uniformity of material properties was excellent. In addition, the hot rolling linear load×the cold rolling linear load was less than 4,000,000 $kgf^2/mm^2$. This means that no defective shape occurs.

<Coating Quality>

The coating quality was evaluated on a scale of 1 to 5 as follows. A coated steel with a rating of 3 or higher was judged as pass.

1: Many bare spots.

2: Bare spots in some parts.

3: No bare spots, but many clear scale patterns were found.

4: No bare spots, but slight scale patterns were found.

5: No bare spots and no scale patterns.

Thus, it was shown that, in each Inventive Example, a high-strength hot-dip galvanized steel sheet excellent in ductility and in-plane uniformity of material properties was obtained, which can contribute to a reduction in weight of automobiles, and contribute to a significant improvement in the performance of automobile bodies, therefore advantageous effects being achieved.

TABLE 1

| | Chemical composition (mass %) | | | | | | | | | | | |
|---|---|---|---|---|---|---|---|---|---|---|---|---|
| Steel | C | Si | Mn | P | S | Al | N | Ti | B | Others | *[Ti]/4[N] | Remarks |
| A | 0.15 | 0.01 | 2.9 | 0.012 | 0.003 | 0.300 | 0.003 | 0.016 | 0.0025 | — | 1.3 | Within inventive range |
| B | 0.17 | 0.10 | 2.7 | 0.016 | 0.002 | 0.500 | 0.003 | 0.021 | 0.0011 | — | 1.8 | Within inventive range |
| C | 0.22 | 0.03 | 2.5 | 0.004 | 0.002 | 0.350 | 0.004 | 0.017 | 0.0015 | — | 1.1 | Within inventive range |
| D | 0.16 | 0.03 | 1.8 | 0.022 | 0.001 | 0.750 | 0.002 | 0.016 | 0.0008 | Cr: 1.2 | 2.0 | Within inventive range |
| E | 0.14 | 0.02 | 1.9 | 0.012 | 0.001 | 0.053 | 0.001 | 0.022 | 0.0011 | Mo: 0.4 | 5.5 | Within inventive range |
| F | 0.18 | 0.01 | 2.9 | 0.022 | 0.005 | 0.062 | 0.003 | 0.021 | 0.0017 | Nb: 0.01 | 1.8 | Within inventive range |
| G | 0.15 | 0.02 | 3.1 | 0.015 | 0.001 | 0.066 | 0.002 | 0.015 | 0.0006 | V: 0.05 | 1.9 | Within inventive range |
| H | 0.14 | 0.51 | 2.8 | 0.028 | 0.003 | 0.033 | 0.003 | 0.018 | 0.0009 | Ni: 0.1 | 1.5 | Within inventive range |
| I | 0.21 | 0.01 | 2.6 | 0.011 | 0.003 | 0.045 | 0.004 | 0.019 | 0.0010 | Cu: 0.2 | 1.2 | Within inventive range |
| J | 0.14 | 0.63 | 2.7 | 0.009 | 0.003 | 0.012 | 0.005 | 0.020 | 0.0010 | Ca: 0.001 | 1.0 | Within inventive range |
| K | 0.13 | 0.80 | 2.8 | 0.015 | 0.001 | 0.025 | 0.001 | 0.010 | 0.0011 | REM: 0.002 | 2.5 | Within inventive range |
| L | 0.11 | 0.02 | 3.2 | 0.013 | 0.003 | 0.028 | 0.002 | 0.021 | 0.0013 | — | 2.6 | Outside inventive range |
| M | 0.27 | 0.02 | 2.3 | 0.015 | 0.002 | 0.029 | 0.003 | 0.020 | 0.0008 | — | 1.7 | Outside inventive range |
| N | 0.13 | 1.20 | 2.7 | 0.013 | 0.001 | 0.041 | 0.003 | 0.016 | 0.0014 | — | 1.3 | Outside inventive range |
| O | 0.18 | 0.01 | 1.2 | 0.007 | 0.002 | 0.008 | 0.004 | 0.018 | 0.0016 | — | 1.1 | Outside inventive range |
| P | 0.19 | 0.03 | 2.5 | 0.018 | 0.004 | 0.037 | 0.004 | 0.001 | 0.0015 | — | 0.1 | Outside inventive range |
| Q | 0.15 | 0.02 | 2.6 | 0.011 | 0.001 | 0.036 | 0.002 | 0.019 | 0.0002 | — | 2.4 | Outside inventive range |

*[Ti]: Ti content (mass %), [N]: N content (mass %)

TABLE 2

| Steel sheet No. | Steel | Hot rolling conditions: Residence time at 600 to 700° C. (s) | Hot rolling conditions: Average coiling temperature (° C.) | Hot rolling conditions: *Difference in coiling temperature between center and edge of steel sheet (° C.) | Cold rolling conditions Rolling reduction (%) | Annealing conditions: *First average heating rate (° C./s) | Annealing conditions: First maximum heating temperature (° C.) | Annealing conditions: *Second average heating rate (° C./s) | Annealing conditions: Annealing temperature (° C.) | Annealing conditions: Holding time during annealing (s) | Annealing conditions: Average cooling rate (° C./s) | Annealing conditions: *Residence time during cooling (s) | Annealing conditions: Tempering temperature (° C.) | *Coating state | Remarks |
|---|---|---|---|---|---|---|---|---|---|---|---|---|---|---|---|
| 1 | A | 2 | 550 | 33 | 50 | 7 | 680 | 0.4 | 800 | 500 | 6 | 5 | — | GA | Inventive Example |
| 2 | | 13 | 550 | 35 | 50 | 7 | 680 | 0.4 | 800 | 500 | 6 | 5 | — | GA | Comparative Example |
| 3 | | 13 | 650 | 40 | 50 | 9 | 680 | 0.4 | 800 | 500 | 6 | 5 | — | GA | Comparative Example |
| 4 | | 2 | 550 | 89 | 50 | 9 | 680 | 0.4 | 800 | 500 | 6 | 5 | — | GA | Comparative Example |
| 5 | B | 3 | 500 | 25 | 50 | 10 | 700 | 0.2 | 780 | 200 | 5 | 3 | 150 | GA | Inventive Example |
| 6 | | 2 | 500 | 30 | 20 | 10 | 700 | 0.2 | 780 | 200 | 5 | 3 | 150 | GA | Comparative Example |
| 7 | | 2 | 500 | 28 | 50 | 0.3 | 700 | 0.2 | 780 | 200 | 5 | 3 | 150 | GA | Comparative Example |
| 8 | | 2 | 500 | 22 | 50 | 10 | 770 | 0.2 | 780 | 200 | 5 | 3 | 150 | GA | Comparative Example |
| 9 | C | 2 | 550 | 42 | 39 | 12 | 620 | 0.5 | 820 | 120 | 15 | 2 | 200 | GI | Inventive Example |
| 10 | | 2 | 550 | 39 | 39 | 12 | 620 | 10 | 820 | 120 | 15 | 2 | 200 | GI | Comparative Example |
| 11 | | 1 | 550 | 44 | 39 | 12 | 620 | 0.5 | 710 | 120 | 15 | 2 | 200 | GI | Comparative Example |
| 12 | D | 2 | 500 | 29 | 46 | 6 | 600 | 0.3 | 830 | 300 | 30 | 2 | — | GI | Inventive Example |
| 13 | | 2 | 500 | 33 | 46 | 25 | 600 | 0.3 | 830 | 10 | 30 | 2 | — | GI | Comparative Example |
| 14 | E | 2 | 450 | 16 | 50 | 10 | 590 | 0.8 | 780 | 200 | 30 | 5 | 200 | GA | Inventive Example |
| 15 | | 2 | 450 | 19 | 50 | 10 | 590 | 0.8 | 780 | 200 | 1 | 5 | 200 | GA | Comparative Example |
| 16 | F | 1 | 500 | 40 | 53 | 6 | 650 | 0.8 | 760 | 250 | 8 | 5 | 250 | GA | Inventive Example |
| 17 | | 1 | 500 | 46 | 53 | 6 | 650 | 0.8 | 760 | 250 | 8 | 0.1 | — | GA | Comparative Example |
| 18 | G | 4 | 500 | 61 | 53 | 20 | 650 | 0.5 | 770 | 300 | 8 | 5 | 150 | GA | Inventive Example |
| 19 | | 4 | 500 | 56 | 53 | 20 | 650 | 0.5 | 880 | 300 | 8 | 5 | 150 | GA | Comparative Example |
| 20 | H | 3 | 500 | 48 | 38 | 10 | 650 | 0.6 | 780 | 300 | 10 | 3 | — | GA | Inventive Example |
| 21 | I | 3 | 500 | 59 | 38 | 10 | 650 | 0.6 | 780 | 300 | 10 | 3 | — | GA | Inventive Example |
| 22 | J | 2 | 550 | 36 | 56 | 10 | 650 | 0.5 | 780 | 300 | 10 | 3 | — | GA | Inventive Example |
| 23 | K | 2 | 550 | 60 | 56 | 10 | 650 | 0.5 | 780 | 300 | 10 | 3 | 300 | GA | Inventive Example |
| 24 | L | 2 | 500 | 39 | 56 | 10 | 650 | 0.5 | 760 | 300 | 10 | 3 | — | GA | Comparative Example |
| 25 | M | 2 | 500 | 25 | 56 | 10 | 650 | 0.5 | 760 | 300 | 10 | 3 | — | GA | Comparative Example |
| 26 | N | 2 | 550 | 22 | 50 | 10 | 650 | 0.5 | 780 | 300 | 10 | 3 | — | GA | Comparative Example |
| 27 | O | 2 | 550 | 34 | 50 | 10 | 650 | 0.5 | 780 | 300 | 10 | 3 | — | GA | Comparative Example |
| 28 | P | 3 | 500 | 58 | 50 | 10 | 650 | 0.5 | 770 | 300 | 10 | 3 | — | GA | Comparative Example |
| 29 | Q | 3 | 500 | 44 | 50 | 10 | 650 | 0.5 | 770 | 300 | 10 | 3 | — | GA | Comparative Example |

*Difference in coiling temperature between center and edge of steel sheet: The difference in average temperature value between a 100 mm widthwise central region of the hot-rolled sheet and its 100 mm lateral edge region immediately before the hot-rolled sheet is coiled into a coil shape.

*First average heating rate: Average heating rate until the maximum heating temperature equal to or lower than 700° C. (the first maximum heating temperature), Second average heating rate: Average heating rate from the first maximum heating temperature to the annealing temperature.

*Residence time during cooling: Residence time in the temperature range of Ms point - 50° C.) to Ms point during cooling after galvanization or after galvannealing.

*Coating state: GI: Hot-dip galvanized steel sheet, GA: Hot-dip galvannealed steel sheet.

TABLE 3

| Steel sheet No. | *Microstructure V(PF) (%) | V(M) (%) | V(γ) (%) | Others (%) | d(M) (μm) | σ(dM) (μm) | Mechanical properties Hardness of martensite Hv | TS (MPa) | Uniform elongation (%) | Local elongation (%) | σ(λ) (%) | Rolling load *Hot rolling linear load × *cold rolling linear load × $10^{-6}$ ($kgf^2/mm^2$) | Coating quality | Remarks |
|---|---|---|---|---|---|---|---|---|---|---|---|---|---|---|
| 1 | 12 | 88 | 0 | 0 | 8 | 3.9 | 455 | 1353 | 6.8 | 4.5 | 2 | 2.4 | 5 | Inventive Example |
| 2 | 23 | 58 | 0 | 19 | 8 | 4.7 | 545 | 1266 | 7.4 | 4.7 | 4 | 2.2 | 5 | Comparative Example |
| 3 | 28 | 51 | 0 | 21 | 8 | 5.6 | 576 | 1232 | 7.5 | 4.4 | 5 | 2.2 | 5 | Comparative Example |
| 4 | 11 | 89 | 0 | 0 | 7 | 4.9 | 452 | 1360 | 6.6 | 4.3 | 6 | 2.4 | 5 | Comparative Example |
| 5 | 28 | 72 | 0 | 0 | 7 | 3.6 | 521 | 1405 | 7.3 | 5.3 | 2 | 2.5 | 5 | Inventive Example |
| 6 | 25 | 75 | 0 | 0 | 9 | 6.1 | 515 | 1426 | 7.1 | 2.6 | 5 | 2.5 | 5 | Comparative Example |
| 7 | 37 | 51 | 0 | 12 | 9 | 5.1 | 599 | 1259 | 7.8 | 4.2 | 5 | 2.5 | 5 | Comparative Example |
| 8 | 24 | 76 | 0 | 0 | 6 | 4.1 | 530 | 1488 | 7.3 | 3.1 | 4 | 2.5 | 5 | Comparative Example |
| 9 | 7 | 65 | 1 | 27 | 10 | 3.8 | 596 | 1592 | 6.6 | 4.8 | 1 | 2.5 | 5 | Inventive Example |
| 10 | 9 | 71 | 1 | 19 | 11 | 5.4 | 590 | 1615 | 6.5 | 3.9 | 4 | 2.5 | 5 | Comparative Example |
| 11 | 88 | 9 | 3 | 0 | 2 | 1.2 | 764 | 816 | 12.8 | 3.9 | 3 | 2.5 | 5 | Comparative Example |
| 12 | 23 | 69 | 0 | 8 | 6 | 2.9 | 510 | 1336 | 7.2 | 4.9 | 2 | 2.4 | 5 | Inventive Example |
| 13 | 39 | 48 | 4 | 9 | 3 | 1.3 | 593 | 1230 | 7.8 | 5.1 | 1 | 2.4 | 5 | Comparative Example |
| 14 | 22 | 75 | 0 | 3 | 2 | 0.4 | 478 | 1305 | 6.8 | 5.0 | 1 | 2.0 | 5 | Inventive Example |
| 15 | 26 | 52 | 0 | 22 | 2 | 0.4 | 583 | 1248 | 7.0 | 4.8 | 2 | 2.0 | 5 | Comparative Example |
| 16 | 26 | 74 | 0 | 0 | 3 | 0.6 | 507 | 1388 | 6.9 | 5.5 | 2 | 2.5 | 5 | Inventive Example |
| 17 | 24 | 1 | 0 | 75 | 3 | 0.6 | 509 | 1451 | 7.3 | 1.8 | 2 | 2.5 | 5 | Comparative Example |
| 18 | 21 | 79 | 0 | 0 | 3 | 0.8 | 471 | 1330 | 7.1 | 4.9 | 2 | 2.5 | 5 | Inventive Example |
| 19 | 0 | 83 | 0 | 17 | 15 | 4.8 | 454 | 1315 | 4.5 | 4.8 | 4 | 2.5 | 5 | Comparative Example |
| 20 | 15 | 83 | 0 | 2 | 5 | 2.9 | 453 | 1328 | 7.3 | 4.3 | 3 | 3.3 | 4 | Inventive Example |
| 21 | 10 | 90 | 0 | 0 | 5 | 3.2 | 499 | 1602 | 5.7 | 3.5 | 3 | 2.5 | 5 | Inventive Example |
| 22 | 9 | 89 | 0 | 2 | 5 | 2.1 | 456 | 1336 | 7.2 | 4.1 | 2 | 3.7 | 3 | Inventive Example |
| 23 | 12 | 88 | 0 | 0 | 6 | 3.6 | 450 | 1303 | 8.0 | 5.3 | 3 | 3.9 | 3 | Inventive Example |
| 24 | 14 | 86 | 0 | 0 | 6 | 2.5 | 445 | 1281 | 7.1 | 4.2 | 3 | 3.5 | 5 | Comparative Example |
| 25 | 10 | 90 | 0 | 0 | 5 | 2.2 | 609 | 1890 | 5.9 | 0.1 | 2 | 2.6 | 5 | Comparative Example |
| 26 | 16 | 84 | 0 | 0 | 5 | 2.0 | 461 | 1346 | 6.7 | 4.4 | 3 | 4.4 | 2 | Comparative Example |
| 27 | 18 | 36 | 1 | 45 | 2 | 0.5 | 612 | 1109 | 6.6 | 3.2 | 2 | 1.5 | 5 | Comparative Example |
| 28 | 15 | 50 | 1 | 34 | 3 | 0.7 | 568 | 1197 | 5.8 | 3.1 | 2 | 2.7 | 5 | Comparative Example |
| 29 | 14 | 55 | 1 | 30 | 3 | 0.5 | 519 | 1169 | 6.1 | 3.6 | 2 | 2.6 | 5 | Comparative Example |

*V(PF): Area fraction of polygonal ferrite, V(M): Area fraction of martensite (auto-tempered martensite or tempered martensite), V(γ): Area fraction of retained austenite, Others: Area fraction of other phases, d(M): Average crystal grain diameter of martensite, σ(dM): Standard deviation of the crystal grain diameters of martensite.
*Hot rolling linear load: Value obtained by dividing the actual load during one pass at 1,050° C. and a rolling reduction of 39% by the width of the sheet.
*Cold rolling linear load: Value obtained by dividing the actual load during one pass at a rolling reduction of 25% by the width of the sheet.

According to aspects of the present invention, a high-strength hot-dip galvanized steel sheet being excellent in ductility and in-plane uniformity of material properties can be obtained, which has a TS of 1,300 MPa or more, a uniform elongation of 5.5% or more, a local elongation of 3% or more, and a standard deviation of λ of less than 4%. When the high-strength hot-dip galvanized steel sheet according to aspects of the present invention is used for automobile steel sheet applications, the steel sheet can contribute to a reduction in weight of automobiles and significantly contribute to an improvement in the performance of automobile bodies.

The invention claimed is:

1. A high-strength hot-dip galvanized steel sheet having a chemical composition comprising, in mass %, C: 0.13 to 0.25%, Si: 0.01 to 1.00%, Mn: 1.5 to 4.0%, P: 0.100% or less, S: 0.02% or less, Al: 0.01 to 1.50%, N: 0.001 to 0.010%, Ti: 0.005 to 0.100%, and B: 0.0005 to 0.0050%, with the balance being Fe and inevitable impurities, the content of Ti and the content of N satisfying formula (1) below, and the high-strength hot-dip galvanized steel sheet having a microstructure including martensite at an area fraction of 60% or more and 90% or less, polygonal ferrite at an area fraction of more than 5% and 40% or less, and retained austenite at an area fraction of less than 3% (including 0%), wherein the martensite has an average hardness of 450 or more and 600 or less in terms of Vickers hardness, wherein the martensite has an average crystal grain diameter of 10 μm or less, and wherein the standard deviation of crystal grain diameters of the martensite is 4.0 μm or less:

$$[Ti]>4\,[N] \quad (1),$$

where [Ti] represents the content of Ti (mass %), and [N] represents the content of N (mass %).

2. The high-strength hot-dip galvanized steel sheet according to claim 1, further comprising, in mass %, at least one element selected from Cr: 0.005 to 2.000%, Mo: 0.005 to 2.000%, V: 0.005 to 2.000%, Ni: 0.005 to 2.000%, Cu: 0.005 to 2.000%, and Nb: 0.005 to 2.000%.

3. The high-strength hot-dip galvanized steel sheet according to claim 2, further comprising, in mass %, at least one element selected from Ca: 0.001 to 0.005% and REM: 0.001 to 0.005%.

4. A method for manufacturing a high-strength hot-dip galvanized steel sheet, the method comprising: a hot rolling step of subjecting a steel slab having the chemical composition according to claim 3 to hot rolling to thereby obtain a hot-rolled sheet, cooling the hot-rolled sheet after completion of finishing rolling in the hot rolling such that a total residence time at 600 to 700° C. is 10 seconds or shorter, and then coiling the resulting hot-rolled sheet such that an average coiling temperature is 400° C. or higher and lower than 600° C. and that the difference between an average value of coiling temperature in a 100 mm-wide region at a widthwise central position of the steel sheet and an average value of the coiling temperature in a 100 mm-wide region at a lateral edge position of the steel sheet is 70° C. or lower; a cold rolling step of cold-rolling the hot-rolled sheet at a rolling reduction of more than 20% to thereby obtain a cold-rolled sheet; an annealing step of heating the cold-rolled sheet to 700° C. or lower at an average heating rate of 5° C./s or more, then heating the resulting cold-rolled sheet to 720° C. or higher and 850° C. or lower at an average heating rate of 1° C./s or less, and holding the resulting cold-rolled sheet at 720° C. or higher and 850° C. or lower for 30 seconds or longer and 1,000 seconds or shorter; a cooling step of cooling the cold-rolled sheet subjected to the annealing step at an average cooling rate of 3° C./s or more; a hot-dip galvanizing step of subjecting the cold-rolled sheet subjected to the cooling step to hot-dip galvanizing treatment to thereby obtain a hot-dip galvanized sheet; and a post-plating cooling step of cooling the hot-dip galvanized sheet subjected to the hot-dip galvanizing step such that a residence time in a temperature range of (an Ms point −50° C.) to the Ms point is 2 seconds or longer.

5. The method for manufacturing a high-strength hot-dip galvanized steel sheet according to claim 4, the method further comprising, after the hot-dip galvanizing step and before the post-plating cooling step, a galvannealing step of subjecting the hot-dip galvanized steel sheet to galvannealing treatment.

6. The method for manufacturing a high-strength hot-dip galvanized steel sheet according to claim 5, the method further comprising, after the post-plating cooling step, a tempering step of performing tempering treatment at a temperature of 350° C. or lower.

7. The method for manufacturing a high-strength hot-dip galvanized steel sheet according to claim 4, the method further comprising, after the post-plating cooling step, a tempering step of performing tempering treatment at a temperature of 350° C. or lower.

8. The high-strength hot-dip galvanized steel sheet according to claim 1, further comprising, in mass %, at least one element selected from Ca: 0.001 to 0.005% and REM: 0.001 to 0.005%.

9. A method for manufacturing a high-strength hot-dip galvanized steel sheet, the method comprising: a hot rolling step of subjecting a steel slab having the chemical composition according to claim 1 to hot rolling to thereby obtain a hot-rolled sheet, cooling the hot-rolled sheet after completion of finishing rolling in the hot rolling such that a total residence time at 600 to 700° C. is 10 seconds or shorter, and then coiling the resulting hot-rolled sheet such that an average coiling temperature is 400° C. or higher and lower than 600° C. and that the difference between an average value of coiling temperature in a 100 mm-wide region at a widthwise central position of the steel sheet and an average value of the coiling temperature in a 100 mm-wide region at a lateral edge position of the steel sheet is 70° C. or lower; a cold rolling step of cold-rolling the hot-rolled sheet at a rolling reduction of more than 20% to thereby obtain a cold-rolled sheet; an annealing step of heating the cold-rolled sheet to 700° C. or lower at an average heating rate of 5° C./s or more, then heating the resulting cold-rolled sheet to 720° C. or higher and 850° C. or lower at an average heating rate of 1° C./s or less, and holding the resulting cold-rolled sheet at 720° C. or higher and 850° C. or lower for 30 seconds or longer and 1,000 seconds or shorter; a cooling step of cooling the cold-rolled sheet subjected to the annealing step at an average cooling rate of 3° C./s or more; a hot-dip galvanizing step of subjecting the cold-rolled sheet subjected to the cooling step to hot-dip galvanizing treatment to thereby obtain a hot-dip galvanized sheet; and a post-plating cooling step of cooling the hot-dip galvanized sheet subjected to the hot-dip galvanizing step such that a residence time in a temperature range of (an Ms point −50° C.) to the Ms point is 2 seconds or longer.

10. The method for manufacturing a high-strength hot-dip galvanized steel sheet according to claim 9, the method further comprising, after the hot-dip galvanizing step and before the post-plating cooling step, a galvannealing step of subjecting the hot-dip galvanized steel sheet to galvannealing treatment.

11. The method for manufacturing a high-strength hot-dip galvanized steel sheet according to claim 10, the method further comprising, after the post-plating cooling step, a tempering step of performing tempering treatment at a temperature of 350° C. or lower.

12. The method for manufacturing a high-strength hot-dip galvanized steel sheet according to claim 9, the method further comprising, after the post-plating cooling step, a tempering step of performing tempering treatment at a temperature of 350° C. or lower.

13. A method for manufacturing a high-strength hot-dip galvanized steel sheet, the method comprising: a hot rolling step of subjecting a steel slab having the chemical composition according to claim 2 to hot rolling to thereby obtain a hot-rolled sheet, cooling the hot-rolled sheet after completion of finishing rolling in the hot rolling such that a total residence time at 600 to 700° C. is 10 seconds or shorter, and then coiling the resulting hot-rolled sheet such that an average coiling temperature is 400° C. or higher and lower than 600° C. and that the difference between an average value of coiling temperature in a 100 mm-wide region at a widthwise central position of the steel sheet and an average value of the coiling temperature in a 100 mm-wide region at a lateral edge position of the steel sheet is 70° C. or lower; a cold rolling step of cold-rolling the hot-rolled sheet at a rolling reduction of more than 20% to thereby obtain a cold-rolled sheet; an annealing step of heating the cold-rolled sheet to 700° C. or lower at an average heating rate of 5° C./s or more, then heating the resulting cold-rolled sheet to 720° C. or higher and 850° C. or lower at an average heating rate of 1° C./s or less, and holding the resulting cold-rolled sheet at 720° C. or higher and 850° C. or lower for 30 seconds or longer and 1,000 seconds or shorter; a cooling step of cooling the cold-rolled sheet subjected to the annealing step at an average cooling rate of 3° C./s or more; a hot-dip galvanizing step of subjecting the cold-rolled sheet subjected to the cooling step to hot-dip galvanizing treatment to thereby obtain a hot-dip galvanized sheet; and a post-plating cooling step of cooling the hot-dip galvanized sheet subjected to the hot-dip galvanizing step such that a residence time in a temperature range of (an Ms point −50° C.) to the Ms point is 2 seconds or longer.

14. The method for manufacturing a high-strength hot-dip galvanized steel sheet according to claim 13, the method further comprising, after the hot-dip galvanizing step and before the post-plating cooling step, a galvannealing step of subjecting the hot-dip galvanized steel sheet to galvannealing treatment.

15. The method for manufacturing a high-strength hot-dip galvanized steel sheet according to claim 14, the method further comprising, after the post-plating cooling step, a tempering step of performing tempering treatment at a temperature of 350° C. or lower.

16. The method for manufacturing a high-strength hot-dip galvanized steel sheet according to claim 13, the method further comprising, after the post-plating cooling step, a tempering step of performing tempering treatment at a temperature of 350° C. or lower.

17. A method for manufacturing a high-strength hot-dip galvanized steel sheet, the method comprising: a hot rolling step of subjecting a steel slab having the chemical composition according to claim 8 to hot rolling to thereby obtain a hot-rolled sheet, cooling the hot-rolled sheet after completion of finishing rolling in the hot rolling such that a total residence time at 600 to 700° C. is 10 seconds or shorter, and then coiling the resulting hot-rolled sheet such that an average coiling temperature is 400° C. or higher and lower than 600° C. and that the difference between an average value of coiling temperature in a 100 mm-wide region at a widthwise central position of the steel sheet and an average value of the coiling temperature in a 100 mm-wide region at a lateral edge position of the steel sheet is 70° C. or lower; a cold rolling step of cold-rolling the hot-rolled sheet at a rolling reduction of more than 20% to thereby obtain a cold-rolled sheet; an annealing step of heating the cold-rolled sheet to 700° C. or lower at an average heating rate of 5° C./s or more, then heating the resulting cold-rolled sheet to 720° C. or higher and 850° C. or lower at an average heating rate of 1° C./s or less, and holding the resulting cold-rolled sheet at 720° C. or higher and 850° C. or lower for 30 seconds or longer and 1,000 seconds or shorter; a cooling step of cooling the cold-rolled sheet subjected to the annealing step at an average cooling rate of 3° C./s or more; a hot-dip galvanizing step of subjecting the cold-rolled sheet subjected to the cooling step to hot-dip galvanizing treatment to thereby obtain a hot-dip galvanized sheet; and a post-plating cooling step of cooling the hot-dip galvanized sheet subjected to the hot-dip galvanizing step such that a residence time in a temperature range of (an Ms point −50° C.) to the Ms point is 2 seconds or longer.

18. The method for manufacturing a high-strength hot-dip galvanized steel sheet according to claim 17, the method further comprising, after the hot-dip galvanizing step and before the post-plating cooling step, a galvannealing step of subjecting the hot-dip galvanized steel sheet to galvannealing treatment.

19. The method for manufacturing a high-strength hot-dip galvanized steel sheet according to claim 18, the method further comprising, after the post-plating cooling step, a tempering step of performing tempering treatment at a temperature of 350° C. or lower.

20. The method for manufacturing a high-strength hot-dip galvanized steel sheet according to claim 17, the method further comprising, after the post-plating cooling step, a tempering step of performing tempering treatment at a temperature of 350° C. or lower.

* * * * *